US005150577A

United States Patent [19]

Mitchell et al.

[11] Patent Number: 5,150,577

[45] Date of Patent: Sep. 29, 1992

[54] SYSTEM AND METHOD FOR RECOVERING AND PURIFYING A HALOCARBON COMPOSITION

[76] Inventors: Mark D. Mitchell, 1313 Queen Anne Rd., Wilson, N.C. 27893; David J. Spring, 25, Springgate Field, Langley, England, SL3 7DH

[21] Appl. No.: 713,970

[22] Filed: Jun. 11, 1991

[51] Int. Cl.[5] ..... F25J 3/04

[52] U.S. Cl. ..... 62/18; 62/48.2; 62/292; 55/74; 55/80

[58] Field of Search ..... 62/8, 18, 48.2, 292; 55/74, 80

[56] References Cited

U.S. PATENT DOCUMENTS

| | | | |
|---|---|---|---|
| 3,415,069 | 12/1968 | Hauser | 62/18 |
| 3,763,901 | 10/1983 | Vilano | 55/88 |
| 4,717,406 | 1/1988 | Giacobbe | 62/18 |
| 4,738,694 | 4/1988 | Godino et al. | 62/18 |
| 5,018,361 | 5/1991 | Kroll et al. | 62/292 |
| 5,076,063 | 12/1991 | Kamegasawa et al. | 62/292 |
| 5,101,637 | 4/1992 | Daily | 62/292 |

*Primary Examiner*—Ronald C. Capossela

*Attorney, Agent, or Firm*—Rhodes Coats & Bennett

[57] ABSTRACT

The present invention relates to a system for recovering and purifying a halocarbon composition, particularly halon. Forming a part of the present system is a liquid heat exchange unit filled with a liquid heat transfer medium. A recovery tank is submerged in the heat transfer medium and is coupled to an impure halocarbon source. The liquid heat exchange unit cools the recovery tank and the impure halocarbon composition within the tank to a sufficient temperature to cause nitrogen gas to separate from the halocarbon composition and form a vapor within the top portion of the recovery tank. Thereafter, the recovery tank is vented and a mixture of separated nitrogen gas and halon vapor is directed through a vent stream having a carbon adsorber. As the separated gas moves through the carbon adsorber, organic halocarbon vapor is adsorbed and effectively removed from the nitrogen gas. Prior to the impure halocarbon composition reaching the recovery tank, the same is subjected to pretreatment and particularly to filtration for removing particulates, moisture, foreign oils and acids.

30 Claims, 5 Drawing Sheets

SYSTEM AND METHOD FOR RECOVERING AND PURIFYING A HALOCARBON COMPOSITION

FIELD OF THE INVENTION

The present invention relates to a method and system for recovering and purifying halocarbons and particularly halon.

BACKGROUND OF THE INVENTION

In recent years, much attention has been focused on the state of the earth's ozone layer. The ozone layer surrounds and protects the earth against harmful ultraviolet radiation. Recently, there have been reports of a marked decrease in the amount of ozone in the earth's atmosphere. Some scientist estimate that as much as 7% of the ozone layer has already been destroyed. Further, researchers have discovered "holes" in the ozone layer. One hole over the continent of Antarctica has an area of more than one million square miles.

The thinning of the earth's ozone layer means that more ultraviolet radiation reaches the earth's surface. The increased exposure to ultraviolet radiation is believed to greatly increase the risk of skin cancer, cataracts, and other illnesses affecting plant and animal life. Certain aliments, such as malignant melanoma, can be life threatening or fatal.

One of the primary causes of ozone depletion is the release of ozone destroying chemicals into the atmosphere. Of most concern are man-made compounds known as chloroflourocarbons (CFC's) and other halogen containing compounds. Chloroflourocarbons are extremely useful for refrigeration and air conditioning systems, as industrial solvents and as foaming agents in the manufacture of plastics. They are also widely used as aerosol propellants. Another useful halogen containing compound is Halon. Halon is widely used in fire extinguishing systems. Halon 1301, for example, is used in fire extinguishing systems for commercial and military aircraft, and is essential to aircraft flight safety.

The universal recognition of the seriousness of the ozone depletion problem has led to international agreements imposing restrictions on the use and manufacture of ozone depleting substances. Current treaty obligations require that the production of ozone destroying chemicals be reduced at least in half by the year 1999. Further, taxation beginning in 1994 of certain ozone depleting substances could render their continued manufacture uneconomical. For example, beginning in 1994, virgin manufacture of Halon 1301 is previously scheduled to be taxed at approximately $26.00 per pound.

These restrictions have made necessary the implementation and design of specialized equipment for the preservation of existing resources of ozone depleting substances used in "essential need" applications. For example, it is essential that the present resource of Halon 1301 from aviation banks be reclaimed, tested and preserved to protect aircraft safety since no other agent in the forseable future will exist to effectively replace Halon 1301.

SUMMARY AND OBJECTS OF THE INVENTION

The present invention is a halocarbon recovery and purification system for recovering and purifying halocarbon compounds. The recovery and purification system includes a heat exchange unit filled with a liquid heat transfer medium. A recovery tank is submerged in the heat transfer medium which is maintained at a temperature well below the boiling point of the agent being recovered. An inlet means is provided for transferring the agent from a source into the recovery tank. As the agent passes through the heat exchange unit into the recovery tank, the agent is cooled to liquify the agent and to effect separation of dissolved gases from the agent. The liquid agent falls to the bottom of the tank and a vapor layer forms above the liquid. Once the recovery is filled to a predetermined level, the gas is vented from the recovery tank through an activated carbon adsorber. The active carbon adsorber adsorbs any organic vapor which is mixed with the gas being vented. A vacuum pump or vapor recovery unit removes the organic vapor trapped by the carbon adsorber and returns it to the inlet portion of the system.

In a preferred embodiment of the invention, an expansion valve is disposed in the recovery tank to take advantage of the refrigeration character of the agent being recovered to lower the energy input needed to operate the heat exchange. The expansion valve restricts flow of agent into the recovery tank to create a pressure. The resulting expansion valve pressure differential has a cooling effect which induces a temperature reduction of the agent being recovered. To avoid excess pressure build up due to restriction at the expansion valve, a ballast tank is connected in the inlet means. The ballast tank effectively limits system pressure by providing a volume into which the agent may flow. As upstream system pressure drops, the recovery tank acts as a cold, lower pressure sink which draws the contents of the ballast tank into the recovery tank. The purified agent which is in the recovery tank is transferred to a storage container without mechanical assistance. The transfer of the agent to the storage container is accomplished by pressurizing the recovery tank with a nonreactive purge gas such as helium, argon or nitrogen. Once the purified agent is transferred to the storage container, the purged gas is vented.

In another aspect of the invention, the inlet means includes two vapor recovery units disposed in a sidestream. At relatively low pressures, a first vapor recovery unit evacuates the source bottle. The vapor recovery unit compresses the agent and returns it to the mainstream. At extremely low pressures, a second vapor recovery unit is activated which is capable of operating at extremely low pressures. The second vapor recovery unit compresses the vaporized agent initially. After this initial pressurization, the vaporized agent is then directed to the first vapor recovery unit where it is compressed further and returned to the mainstream. This dual stage vapor recovery allows for complete evacuation of the source bottle down to 2 psi.

In a second embodiment of the invention, the transfer of the recovered agent from the recovery tank is accomplished by allowing nitrogen to build-up to a high pressure in the carbon adsorber and using reverse flow of nitrogen to purge the recovery tank. Nitrogen vapor is allowed to flow into an accumulator and carbon adsorber during the recovery phase of operation. Once pressure between the accumulator and carbon adsorber equalize at a predetermined level, the recovery tank is partially evacuated to remove remaining nitrogen. This additional vapor is pumped by a vapor recovery unit into the accumulator, and carbon adsorber to pressurize those elements. To transfer the purified halon to a storage container, the nitrogen in the carbon adsorber and accumulator is allowed to backflow into the recovery tank. Initial pressure backflow effecting a pressurization decrease in the carbon bed allows entrapped halon vapor to be removed. Secondly, followed by reverse purge using an inert gas effects further removal of halon from the carbon bed. Upon completion of liquid transfer excess remaining nitrogen and inert gas is vented to the atmosphere. Any remaining halon is captured by the carbon bed.

Based on the foregoing, it is a primary object of the present invention to provide a halocarbon recovery and purification system to more efficiently remove and purify contaminated halocarbon from a source bottle.

Another object of the present invention is to provide a halocarbon recovery and purification system which can efficiently transfer halocarbons from a source bottle to a storage container without releasing the halocarbon compounds to the atmosphere.

It is another object of the present invention to provide a halocarbon recovery and purification system in which energy stored and the agent being recovered is used as an energy source so as to minimize external energy input needed to operate the system.

Another object of the present invention is to provide a halocarbon recovery and purification system which is capable of efficiently separating dissolved gases from the agent being recovered.

Another object of the present invention is to provide a halocarbon recovery and purification system which is capable of separating nonazeotrophic mixtures of halocarbons.

Another object of the present invention is to provide a halocarbon recovery and purification system which does not require mechanical assistance to transfer the recovered agent to a storage container.

Yet another object of the present invention is to provide a halocarbon recovery and purification system which is capable of evacuating a source bottle down to a pressure of 2 psi.

Another object of the present invention is to provide a halocarbon recovery and purification system which utilizes commercially available components so as to eliminate the need for custom manufactured parts.

Other objects and advantages of the present invention will become apparent and obvious from a study of the following description and the accompanying drawings which are merely illustrative of such invention.

DETAILED DESCRIPTION OF THE INVENTION

Figure 1:
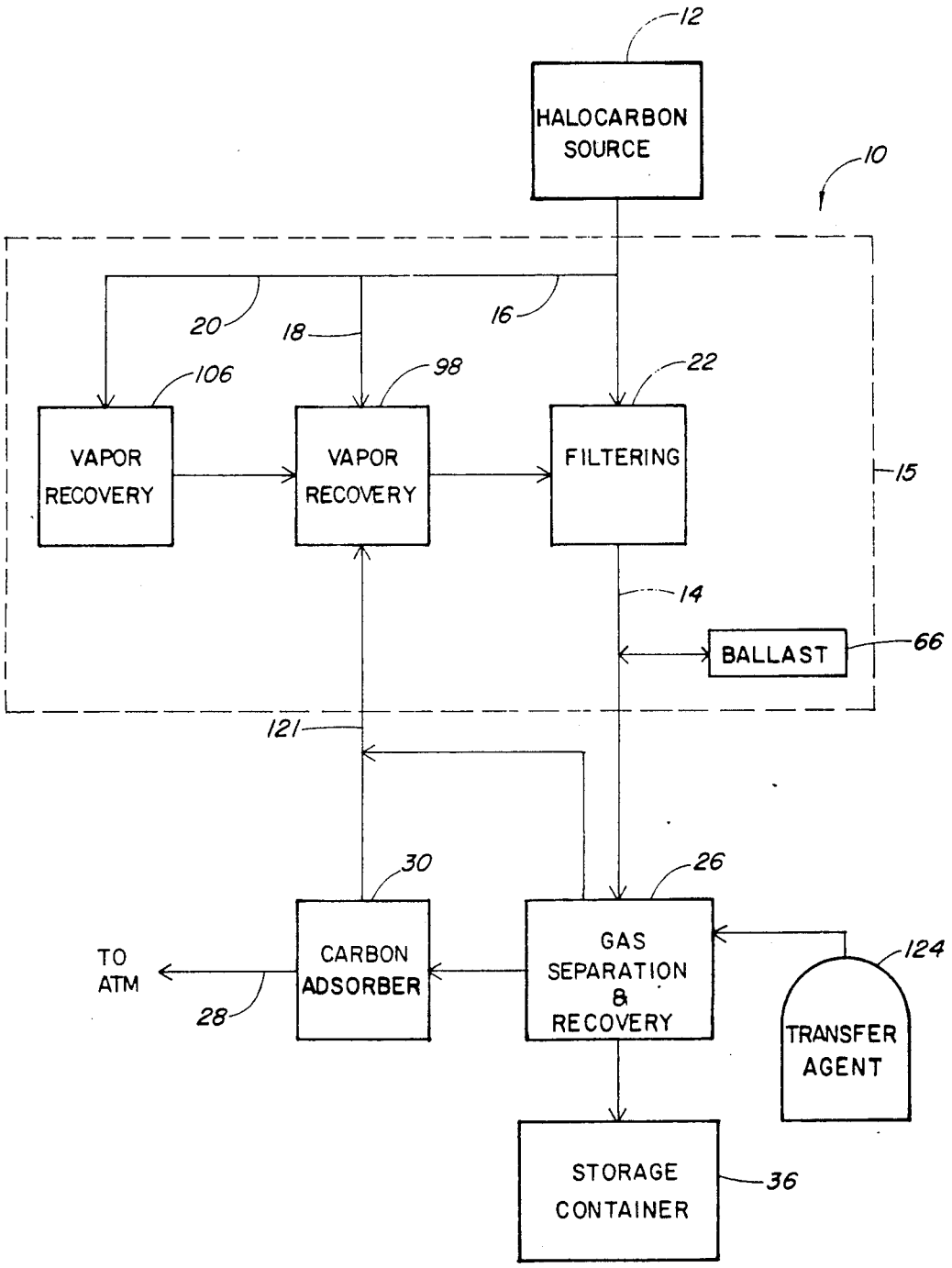
FIG. 1 is a block diagram of the halocarbon recovery and purification system.

Referring now to the drawings, and particularly to FIG. 1, the halon recovery system of the present invention is shown schematically and indicated generally by the numeral 10. The halon recovery system 10 is used for recovering halon from a source 12, purifying the halon, and then transferring the halon into a storage container 36. During the recovery phase of operation halon passes from the source 12 through an inlet section 15 into a gas separation and recovery unit 26 where dissolved nitrogen is separated from the halon. In the gas separation phase, dissolved nitrogen in the recovery tank 80 is vented to the atmosphere through a vent stream 28 containing a carbon adsorber 30. The carbon adsorber 30 traps any organic halon vapor which is mixed in the nitrogen gas. After venting the gas from the recovery tank 26, the transfer phase of operation begins in which the recovery tank 26 is pressurized with a purge gas 124 to transfer the purified halon to a storage container 36. The halon vapor trapped in the carbon adsorber 30 is then evacuated from the carbon adsorber 30 and returned to the inlet section 15 of the system circuit return an evacuation stream 121.

The inlet section 15 includes a filtering stage 22 in the mainstream 14 for removing moisture, oils, and particulate matter from the halon as it flows from the source 12 to the gas separation and recovery unit 26. The inlet means 15 also includes two vapor recovery units 98 and 106 located in a sidestream 16 to fully evacuate the source 12. The vapor recovery units 98 and 106 are located in separate branches 18 and 20 of the sidestream 16. When the pressure at the source 12 drops to a predetermined level, the first vapor recovery unit 98 is started to assist evacuation of the source 12. The first vapor recovery unit 98 compresses the recovered halon and returns it to the filtering stage 22 in the mainstream 14. At extremely low pressures, the second vapor recovery unit 106 is actuated to assure complete removal of halon from the source 12. The second vapor recovery unit 106 compresses the recovered halon vapor and directs it the first vapor recovery unit 98 which further compresses the halon vapor before returning it to the filtering stage 22.

Figure 2:
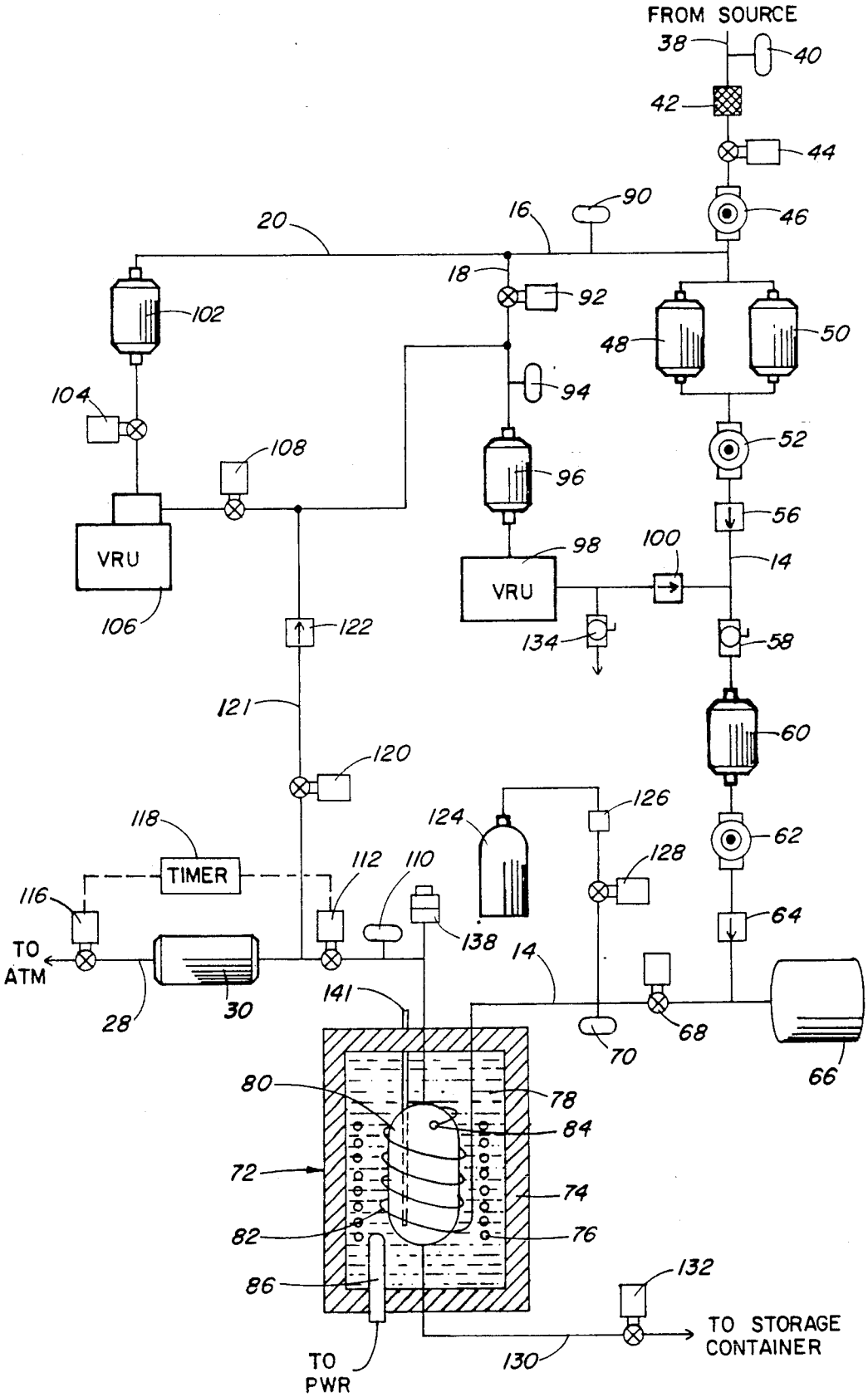
FIG. 2 is a more detailed schematic diagram of the halocarbon recovery and purification system.

Referring now to FIG. 2, a more detailed diagram of the Halon recovery system is shown. The mainstream 14 includes an inlet hose 38 for connecting a bottle containing halon or other halocarbon compound. A pressure switch 40 is disposed adjacent the inlet hose 38 to detect pressures above 50 psi at the source. The pressure switch 40 actuates solenoid valves 44 and 68 permitting fluid to flow from the source 12 to the recovery tank 80. Liquid state halon, which may contain some high pressure vapor, flows from the source 12 through a mechanical filter 42 having a 10 micron nominal rating to remove particulate matter larger than an absolute 25 micron size. The liquid state halon then flows through a visual indicator 46 to a pair of filter dryers 48 and 50. The visual indicator 46 permits the solution to be visually inspected for moisture. Filter dryers 48 and 50 remove moisture, oils, particulate matter and acid to an initial predetermined level. Visual indicator 52 at the output of the filter dryers 48 and 50 provides a visual indication of stream content leaving the filter dryers 48 and 50 so that the operator will be aware when the filters need replacing. The liquid state halon continues to flow through flow check valve 56 and ball valve 58. The ball valve 58 is used when changing filter components to minimize loss of halon. A two-stage filter dryer 60 further cleans and purifies the liquid halon. Visual indicator 62 provides a visual indication of the stream content leaving filter dryer 60. The flow of liquid Halon continues through check valve 64 to the gas separation and recovery unit 26. The gas separation and recovery unit 26 comprises a heat exchange unit 72 and a recovery tank 80. The heat exchange unit 72 includes an insulated enclosure 74 which is filled with a liquid heat transfer medium 78. Refrigeration coils 76 cool the heat transfer medium to about −55° to −70° C. The heat exchange medium 78 comprises approximately 55–58% automotive antifreeze, 22–25% water, and 20% denatured alcohol. The denatured alcohol comprises approximately 82% ethanol, 4% methanol, 1% MIBK, and 13% isopropanol. The heat exchange medium is non-flammable at temperatures below 55° C. and is self-extinguishing above 55° C. This solution can be formulated to provide a slush point of −85° C.

A recovery tank 80 is completely submerged in the heat exchange unit 72. The recovery tank 80 is preferably constructed from 21-6-9 stainless steel. This material has superior toughness which can withstand the pressure cycling to which the recovery tank 80 is subjected. Also, it retains its strength without becoming brittle at extremely low temperatures and is corrosion resistant.

Figure 3:
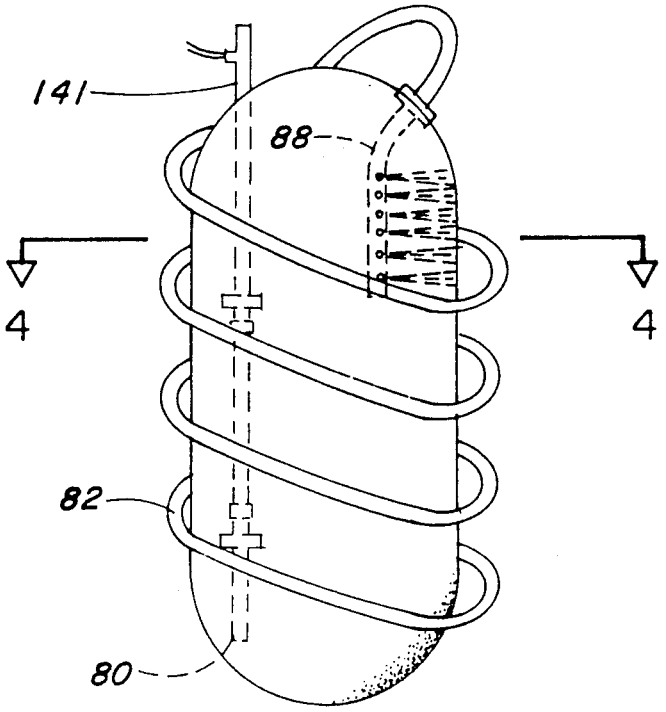
FIG. 3 is an elevation view of the recovery tank which is part of the halocarbon recovery and purification system.

The recovered halon enters the recovery tank 80 through a helical tube 82 which terminates at an expansion valve 84. The halon is pre-chilled as it passes through the helical tube 82 to completely liquify the halon. The expansion valve 84 comprises a perforated tube 88 which sprays the liquified halon against the inner wall of the recovery tank 80 as shown best in FIGS. 3 and 4. The expansion valve 84 also restricts the flow of halon into the recovery tank. The resulting pressure differential has a cooling effect due to the refrigeration character of halon which minimizes the energy input needed to cool the liquid. In other words, the cooling contribution of the liquid halon means that the cooling requirement of the heat exchange unit 72 is reduced. This reduced cooling requirement is a significant advantage over prior art systems.

Figure 4:
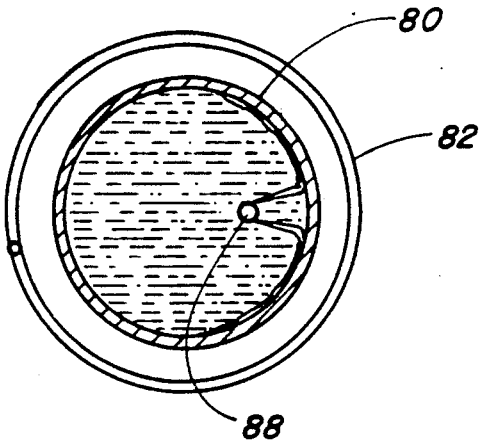
FIG. 4 is a section view of the recovery tank taken through line 4—4 of FIG. 3.

The cooling of halon to below its boiling point results in disassociation of nitrogen gas from the halon. This disassociation is a result of nitrogen's poor solubility in halon at extremely low temperatures. By spraying the halon against the walls of the recovery tank as seen in FIG. 4, separation of the nitrogen gas from the halon is enhanced. Other forms of mechanical agitation could also be used to assist the separation of nitrogen gas from the halon. For example, two or more perforated tubes 88 could be oriented so that the halon sprayed from one tube intersects and collides with the spray from the other tube.

Due to restriction of flow of the expansion valve 84, there may be a significant build-up of pressure in the mainstream 14. In the event of a pressure feed surge, the halon will flow into a closed ballast tank 66 located in the mainstream 14 with a volume of 630 cubic inches (10.3 liters). The ballast tank 66 limits system pressure to approximately 600 psi from a fire extinguisher bottle charged to 1000 psi. By controlling maximum system pressure in this manner, commercial off-the-shelf filter dryers having lower burst pressures can be used, rather than more costly, custom-built filter dryers.

The halon continues to flow from the source 12 to the recovery tank 80 through the mainstream 14 until the pressure sensed at pressure sensor 90 drops to 265 psi. When the pressure at sensor 90 drops to 265 psi, valve 92 opens to start the vapor recovery unit 98 which draws the remaining vapor state halon mixed with low pressure liquid halon from the source 12 into the sidestream 16. The halon flows through branch 18 where it is filtered by filter dryer 96. The halon then passes through the vapor recovery unit 98 where it is compressed and returned to the mainstream 14. Check valve 100 prevents backflow of halon from the mainstream 14 into the vapor recovery unit 98.

When the pressure drops to 18 psi at pressure sensor 94, valve 92 is closed and valves 104 and 108 are opened. The low-pressure, vapor state halon is then pulled from the source through branch 20, by vapor recovery unit 106. The halon stream flows through filter-dryer 102 into the low-pressure side of the vapor recovery unit 106. The halon is compressed and exits the high pressure side where it is directed to branch 18 where the vapor recovery unit 98 is located. Filter-dryer 96 adsorbs any oil introduced into the process by the vacuum pump. The vapor recovery unit 98 further compresses the halon and returns it to the mainstream 14. The vapor recovery unit 106 evacuates the source bottle to 2 psi at which time the vapor recovery unit 106 is de-energized and valves 104, 108 and 44 are closed. The empty source bottle is then disconnected from the input hose 38 and another source bottle is connected.

This recovery process continues until the recovery tank 80 is filled to a predetermined level. Any suitable level detector can be used to indicate when the recovery tank is full and to initiate the gas separation phase. Alternately, a pressure indicator could be used in place of a level detector to stop the recovery of halon from the source bottle at a predetermined pressure.

Upon sensing the start of the gas separation phase, valve 44 closes and valve 112 in the vent stream 28 is opened which in turn activates timed relay 118. The logic of pressure sensor 44 is overridden to stop recovery of halon from the source 12. The vapor layer above the liquid halon in the recovery tank 80 is vented through the carbon adsorber 30. When the timer 118 goes off, valve 116 is opened releasing the nitrogen gas to the atmosphere. The timer 118 assures that the vented gas will be resident in the carbon adsorber for a sufficient time to allow the pressure to drive any organic halon vapor mixed with the nitrogen vapor into the activated carbon in the carbon adsorber 118. When the pressure at pressure sensor 110 drops to 60 psi, valves 116 and 68 both close. Valve 112 remains open. Valve 120 opens and the vapor recovery unit 98 is started. The vapor recovery unit 98 discharges into the closed ballast 66 until it is shut off when the pressure at pressure sensor 94 reaches 12 psi. Since valve 112 remains open, complete nitrogen removal from the recovery tank is assured. Also, organic halon vapor trapped in the carbon adsorber 30 is removed by vacuum to reactivate the carbon adsorber 30.

When the pressure at pressure sensor 70 reaches 12 psi, valves 112 and 120 close and valve 128 opens to begin the transfer of purified halon from the recovery tank 80 to the storage container 36. A non-reactive purge gas flows from container 124 pressurizing the recovery tank 80. The purge gas may be an inert gas such as helium or argon, or may be a gas which is non-reactive with halon at low temperatures such as nitrogen. When the pressure in the recovery tank 80 reaches 280 psi as indicated by sensor 70, valve 132 opens to transfer the liquid halon to the storage container 36. Transfer of the purified halon into the recovery tank continues until the low level switch within the recovery tank 80 is activated. Valves 128 and 132 then close. Valves 112 and 116 open to vent the purge gas from the recovery tank 80. At 60 psi, valve 116 closes. Valve 120 opens and vapor recovery unit 98 is activated to pump any remaining vapor to the closed ballast 66. Once the recovery tank 80 is evacuated, vapor recovery unit 98 switches off and valves 112 and 120 close. Valve 68 reopens and the system resets. If pressure is detected at sensor 40, valves 44 and 68 open to begin the system cycle. Otherwise, the system remains in standby mode.

If it is determined that the contents of the recovery tank 80 is a mixture of halocarbon by boiling point analysis the transfer phase of operation is modified to effect non-azeotropic separation of the halocarbon. The temperature control system is set for an appropriate temperature to affect vaporization of the compound having the lowest boiling point. For example, if Halon 1301 is contaminated with Halon 1211, the temperature is set to boil off the Halon 1301. The temperature of the heat exchange is raised by a resistance type heating rod 86. This step is preformed after venting the nitrogen gas from the recovery tank 80. At this point, valves 112 and 120 remain open. As the Halon 1301 vaporizes, the vapor is removed by the vapor recovery unit 98 and pumped to a storage container through ball valve 134 which is manually actuated. The vacuum recovery unit shuts off at 12 psi and ball valve 134 is closed.

Following removal of the Halon 1301 from the recovery tank 80 by the vapor recovery unit 98, valve 128 opens to pressurize the recovery tank 80 as previously described. Valve 132 is opened to permit transfer of the Halon 1211 to a storage container. The recovery tank 80 is purged as normal except low level switch is bypassed to allow complete purge of the recovery tank 80. When the purging of the recovery tank is complete, valve 132 is closed and the system is reset.

Figure 5:
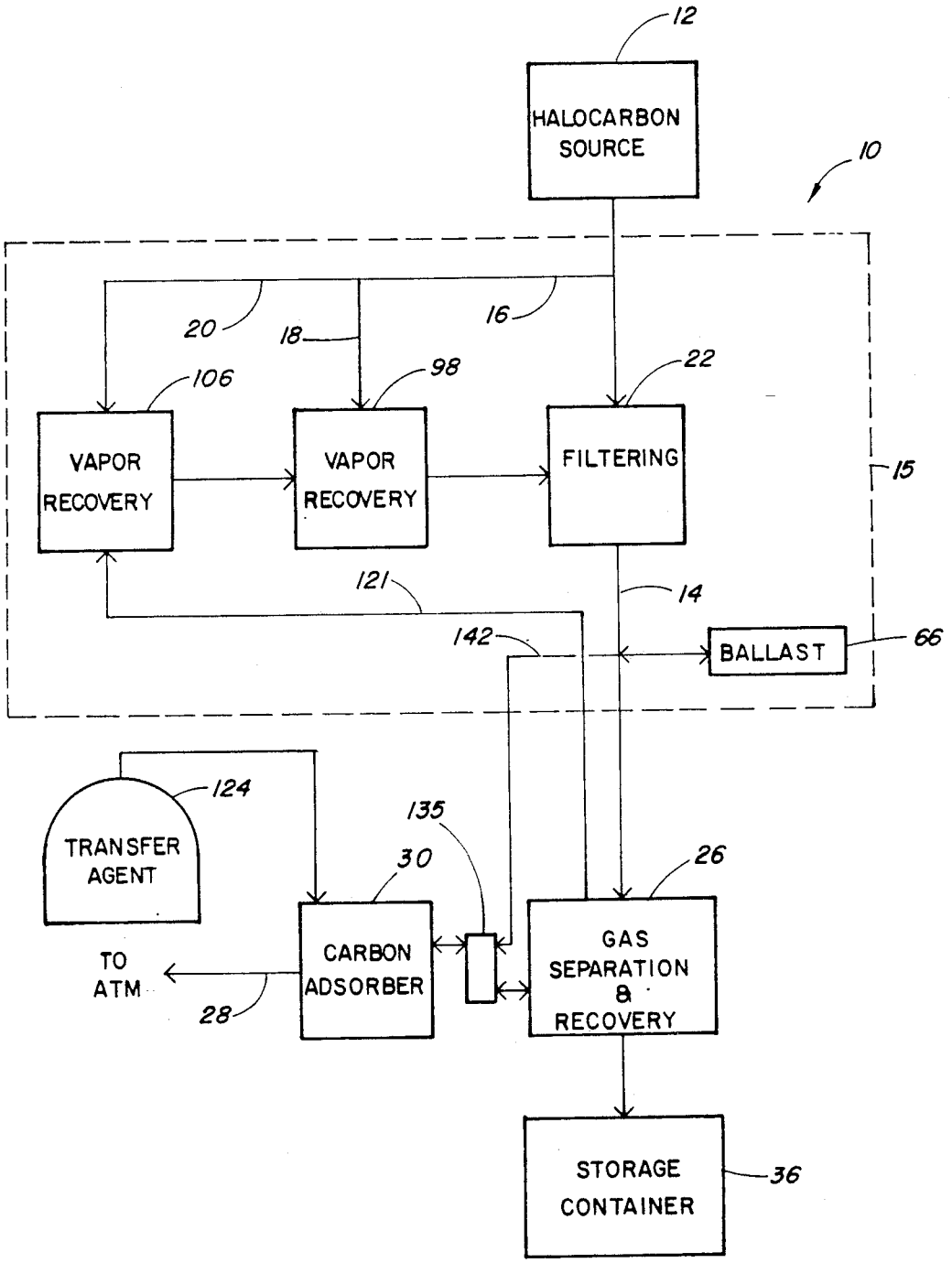
FIG. 5 is a block diagram of a second embodiment of the halocarbon recovery and purification system.
Figure 6:
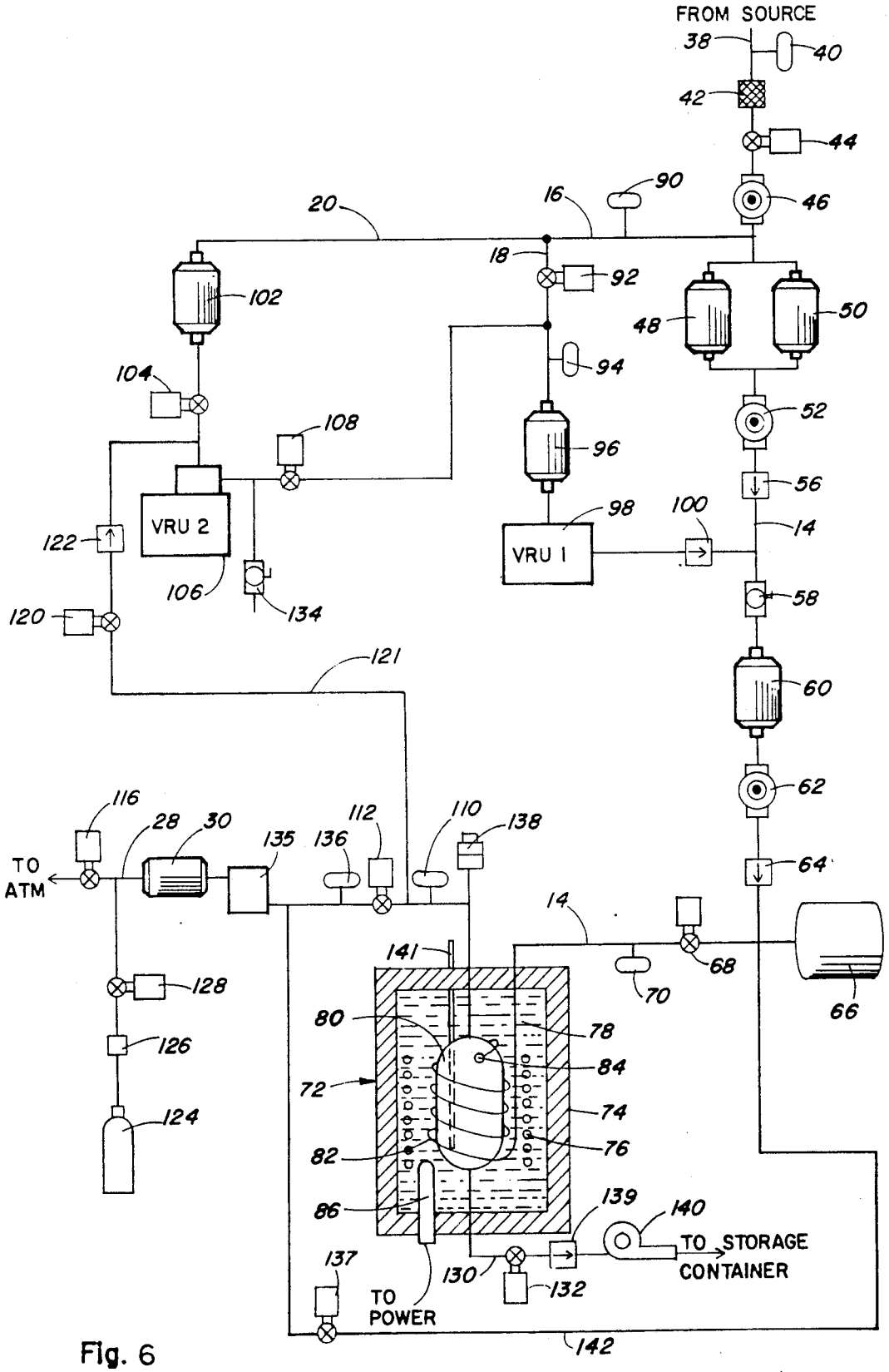
FIG. 6 is a more detailed schematic diagram of the halocarbon recovery and purification system.

Referring now to FIGS. 5 and 6, a second embodiment of the halon recovery and purification system 10 is shown. The second embodiment of the invention is substantially similar to the first embodiment and similar reference numerals in the descriptions of the two embodiments indicate corresponding components. The second embodiment differs from the first embodiment in the manner in which the recovery tank 80 is purged and in the manner in which the carbon adsorber 30 is evacuated. More particularly, the second embodiment utilizes the pressure of the nitrogen vapor separated from the halon in combination with a backflow technique to effect transfer of halon from the recovery tank 80 to the storage container 36.

The second embodiment is shown in block diagram form in FIG. 5. This embodiment includes an inlet means 15, a gas separation and recovery unit 26, and a carbon adsorber 30 which remain substantially the same. An accumulator 135 is located between the gas separation and recovery unit 26 and the carbon adsorber 30. During the recovery phase of operation, halon accumulates in the gas separation and recovery unit 26. Nitrogen vapor is allowed to flow into the accumulator 135 and carbon adsorber 30 until the recovery unit 26 is full at which time the gas separation phase begins. The remaining nitrogen vapor is pumped by vapor recovery unit 106 and 98 from the gas separation and recovery unit 26. The nitrogen vapor is directed through a bypass line 142 into the accumulator 135 and carbon adsorber 30. Some nitrogen vapor also flows into the closed ballast 66. This action removes the remainder of the previously dissolved nitrogen from the recovery unit 80 and pressurizes the accumulator 135, carbon adsorber 30, and ballast 66. This ends the gas separation phase of operation. In the transfer phase of operation high pressure in the accumulator 135, carbon adsorber 30, and ballast tank 66 is allowed to backflow into the recovery tank 80. The backflow of pressurized nitrogen gas from the carbon adsorber into the recovery tank 80 transfers the purified halon into a storage container 36. The halon vapor trapped in the carbon adsorber 30 is mostly returned to the recovery tank 80 during this purging phase where additional condensation occurs. Recovery tank 80, accumulator 135 and carbon adsorber 30 are then vented to the atmosphere. The carbon adsorber 30 traps any organic halon vapor which is mixed in the vent stream. If necessary, a purge gas may be used to effect the backflow of nitrogen gas and halon vapor from the carbon adsorber 30 into the recovery tank 80.

Referring now to FIG. 6, a more detailed schematic of the second embodiment is shown. As in the first embodiment, the recovered agent flows from a source container 12 into a recovery tank 80 through a series of filters. As the pressure at the source 12 drops, a first vapor recovery unit 98 and then a second vapor recovery unit 106 are sequentially activated to evacuate source 12 as previously described. The transfer of the agent from the source 12 to the recovery tank 80 is done in the same manner as the first embodiment. Reference to the description of the first embodiment should be made for a complete description of the input means 15 and the recovery phase of the system cycle.

During the recovery phase of operation, valve 112 opens when a predetermined pressure is sensed at sensor 110 so that nitrogen vapor separated from the recovered agent flows into the accumulator 135 and carbon adsorber 30. The recovery phase continues as previously described until the recovery tank 80 is filled and the high liquid level indicator initiates the gas separation phase.

Upon sensing the start of the gas separation phase, valves 44 and 68 close and valves 137, 120, and 108 open. The logic of pressure sensor 44 is overidden to stop recovery of halon from source 12. The vapor layer above the liquid halon in the recovery tank 80 is removed by vapor recovery unit 106 and feeds vapor recovery unit 98. The vapor is compressed and directed into ballast 66, accumulator 135 and carbon adsorber 30. Evacuation continues from recovery tank 80 until pressure switch 70 indicates 12 psi. Solenoid valve 116 is operated as controlled by pressure switch 136 to limit compression of ballast 66, accumulator 135 and carbon adsorber 30 to 315 psi. At 12 psi in recovery tank 80 valves 108 and 120 close and vapor recovery units 106 and 98 de-energize. Valve 112 opens to begin the transfer of purified halon from the recovery tank 80 to the storage container 36. This action induces reverse flow of nitrogen gas from accumulator 135, carbon adsorber 30 and ballast 66 which results in pressurization of the recovery tank 80. The depressurization of the carbon adsorber 30 effects removal of halon vapor entrapped in the carbon adsorber. Upon pressure switch 110 indicating 150 psi valve 128 opens to transfer the purified halon to the storage container 36. A purge gas can be used if needed to assist the transfer of purified halon to the storage container. If so, a container 124 is connected to the vent stream 28. The purge gas flows from container 124 pressurizing, in a reverse flow manner, carbon adsorber 30, accumulator 135 and ballast tank 66.

The purge gas may be an inert gas such as helium or argon, or may be a gas which is non-reactive with halon at low temperatures such as nitrogen. When the pressure in the recovery tank 80 reaches 280 psi as indicated by sensor 70, valve 132 opens or optional pump 140 starts to transfer the liquid halon to the storage container 36. Transfer of the purified halon into the recovery tank 80 continues until the low level switch within the recovery tank is activated. Valves 128, 132 and 137 then close. Valves 112 and 116 open to completely vent the purge gas from the recovery tank 80. Valves 112 and 116 close upon complete venting of recovery tank 80. Valve 68 reopens permitting any vapor in the ballast tank to enter recovery tank 80 and the system resets. If pressure is detected at sensor 40, valve 44 opens to begin the system cycle. Otherwise, the system remains in standby mode.

If it is suspected that the agent being recovered contains a mixture of different halocarbons, a sample of the recovered agent can be extracted for boiling point analysis. Cross-contamination of Halon 1211 and Halon 1301 will often be encountered. Such cross contamination can be detected by sampling the recovered agent for boiling point at 14 to 15 psi or any other temperature corrected pressure. Mixtures of halon that do not form azeotropes follow a boiling point depression relationship as described by Francois Raoult. By measuring the boiling point of the recovered Halon, it can be determined what other Halons are present. Pure Halon 1301 boils at −57.7° C. at a pressure of 14.69 psi.

If it is determined that the contents of the recovery tank 80 is a mixture of halocarbon by boiling point analysis, the temperature control system is set for an appropriate temperature to affect vaporization of the compound having the lowest boiling point. For example, if Halon 1301 is contaminated with Halon 1211, the temperature is set to boil off the Halon 1301. The temperature of the heat exchange is raised by a resistance type heating rod 86. This step is preformed after venting the nitrogen gas from the recovery tank 80. At this point, valve 120 remains open. As the Halon 1301 vaporizes, the vapor is removed by the vapor recovery unit 98 and pumped to a storage container through ball valve 134 which is manually actuated. The vacuum recovery unit shuts off at 12 psi and valve 120 closes. Ball valve 134 is closed manually.

Following removal of the Halon 1301 from the recovery tank 80 by the vapor recovery unit 98, valve 128 and valve 112 open to pressurize the recovery tank 80 as previously described. Valve 132 is opened to permit transfer of the Halon 1211 to a storage container. The recovery tank 80 is purged as normal except low level switch is bypassed to allow complete purge of the recovery tank 80. When the purging of the recovery tank is complete, valve 132 is closed and the system is reset.

The present invention may, of course, be carried out in other specific ways than those herein set forth without parting from the spirit and essential characteristics of the invention. The present embodiments are, therefore, to be considered in all respects as illustrative and not restrictive, and all changes coming within the meaning and equivalency range of the appended claims are intended to be embraced therein.

We claim:

1. A halocarbon recovery and purification system for removing nitrogen gas from a halocarbon composition source comprising:

a) a liquid heat exchange unit for holding a liquid heat transfer medium;

b) means for cooling the heat exchange unit and the liquid heat transfer medium therein;

c) a halocarbon recovery tank submerged in the heat exchange unit;

d) inlet means for transferring the halocarbon composition from the source into the recovery tank;

e) means for cooling the heat exchange unit, the liquid heat transfer medium therein, the recovery tank and the halocarbon composition therein to a sufficient level to separate nitrogen gas from the halocarbon composition; and f) vent means associated with the recovery tank for venting the separated nitrogen gas from the recovery tank.

2. The halocarbon recovery and purification system of claim 1 wherein there is provided an expansion valve between the inlet means and the recovery tank for increasing the pressure of the halocarbon composition and cooling the same prior to the halocarbon composition settling in the recovery tank.

3. The halocarbon recovery and purification system of claim 2 wherein the expansion valve includes means for agitating the halocarbon composition prior to the halocarbon composition settling in the recovery tank.

4. The halocarbon recovery and purification system of claim 1 wherein the vent means includes a vent stream having a carbon absorption filter for absorbing organic halocarbon vapor from the separated gas being vented through the vent stream.

5. The halocarbon recovery and purification system of claim 4 wherein the system includes means for vacuuming the collected halocarbon composition from the carbon absorption filter so as to rejuvenate the same.

6. A halocarbon recovery and purification system for removing nitrogen gas from a halocarbon composition source comprising:

a) a halocarbon recovery tank;

b) inlet means connected between the halocarbon source and the recovery tank for transferring the halocarbon composition from the source into the recovery tank;

c) cooling means for cooling the recovery tank and halocarbon composition therein to a sufficient level to separate nitrogen gas from the halocarbon composition;

d) vent means associated with the recovery tank for venting the separated nitrogen gas from the recovery tank; and e) the vent means including a vent stream having a carbon adsorber filter therein for absorbing organic halocarbon vapor associated with the vented gas.

7. The halocarbon recovery and purification system of claim 6 wherein the system includes means for vacuuming the collected halocarbon composition from the carbon absorption filter so as to rejuvenate the same.

8. A halocarbon recovery and purification system for removing nitrogen gas from a halocarbon composition source comprising:

a) a halocarbon recovery tank;

b) inlet means connected between the halocarbon source and the recovery tank for transferring the halocarbon composition from the source into the recovery tank;

c) cooling means for cooling the recovery tank and halocarbon composition therein to a sufficient level to separate nitrogen gas from the halocarbon composition;

d) vent means associated with the recovery tank for venting the separated nitrogen gas from the recovery tank; and e) a ballast tank associated with the inlet means for establishing a predetermined volume for holding portions of the halocarbon composition and limiting the pressure within the inlet means.

9. The halocarbon recovery and purification system of claim 8 wherein there is provided an expansion valve between the inlet means and the recovery tank for increasing the pressure of the halocarbon composition and cooling the same prior to the halocarbon composition settling in the recovery tank.

10. The halocarbon recovery and purification system of claim 9 wherein the expansion valve includes means for agitating the halocarbon composition prior to the halocarbon composition settling in the recovery tank.

11. A halocarbon recovery and purification system for removing nitrogen gas from a halocarbon composition source comprising:

a) a halocarbon recovery tank;

b) inlet means connected between the halocarbon source and the recovery tank for transferring the halocarbon composition from the source into the recovery tank;

c) cooling means for cooling the recovery tank and halocarbon composition therein to a sufficient level to separate nitrogen gas from the halocarbon composition;

d) vent means associated with the recovery tank for venting the separated nitrogen gas from the recovery tank; and e) a purge tank having a non-reactive gas therein connected to the recovery tank for selectively pressurizing the recovery tank and transferring the purified halocarbon composition within the recovery tank to a storage tank.

12. A halocarbon recovery and purification system for removing nitrogen gas from a halocarbon composition source comprising:

a) a halocarbon recovery tank;

b) inlet means connected between the halocarbon source and the recovery tank for transferring the halocarbon composition from the source into the recovery tank;

c) cooling means for cooling the recovery tank and halocarbon composition therein to a sufficient level to separate nitrogen gas from the halocarbon composition;

d) vent means associated with the recovery tank for venting the separated nitrogen gas from the recovery tank; and e) a vapor recovery unit disposed within the inlet means and operative to induce halocarbon vapor from the source once the pressure within the inlet means has decreased to a selected pressure level.

13. The halocarbon recovery and purification system of claim 12 wherein the inlet means includes a pair of vapor recovery units coupled to the source for inducing halocarbon composition from the source when the pressure of the halocarbon composition within the source has dropped to a selected level; the pair of vapor recovery units being operable in sequence and at different pressure levels with a first vapor recovery unit being operative to induce halocarbon vapor from the source at a relatively low pressure level while the second vapor unit is operative to induce halocarbon vapor from the source at still a lower pressure level and wherein the second vapor recovery unit is connected to the first vapor recovery unit such that induced halocarbon composition passing through the second vapor recovery unit is directed to and through the first vapor recovery unit.

14. The halocarbon recovery and purification system of claim 12 wherein the inlet means is provided with a second vapor recovery unit which is connected to both the source and the first vapor recovery unit; and wherein the first and second vapor recovery units are operable in sequence and at different pressure levels with the first vapor recovery unit being operative to induce halocarbon vapor from the source at a relatively low pressure level while the second vapor unit is operative to induce halocarbon vapor from the source at still a lower pressure level and wherein the second vapor recovery unit is operative to direct induced halocarbon vapor to and through the first vapor recovery unit.

15. A halocarbon recovery and purification system for removing nitrogen gas from a halocarbon composition source comprising:

a) a halocarbon recovery tank;

b) inlet means connected between the halocarbon source and the recovery tank for transferring the halocarbon composition from the source into the recovery tank;

c) cooling means for cooling the recovery tank and halocarbon composition therein to a sufficient level to separate nitrogen gas from the halocarbon composition;

d) vent means associated with the recovery tank for venting the separated nitrogen gas from the recovery tank; and e) an expansion valve interposed between the inlet means and the recovery tank for increasing the pressure of the halocarbon composition and consequently cooling the halocarbon composition passing through the expansion valve prior to the halocarbon composition settling in the recovery tank.

16. The halocarbon recovery and purification system of claim 15 wherein the expansion valve includes means for agitating the halocarbon composition prior to the halocarbon composition settling in the recovery tank.

17. A halocarbon recovery and purification system for removing nitrogen gas from a halocarbon composition source comprising:

a) a halocarbon recovery tank;

b) inlet means connected between the halocarbon source and the recovery tank for transferring the halocarbon composition from the source into the recovery tank;

c) cooling means for cooling the recovery tank and halocarbon composition therein to a sufficient level to separate nitrogen gas from the halocarbon composition; and d) means for removing the separated nitrogen gas from the recovery tank, holding the separated nitrogen gas, pressurizing the separated nitrogen gas, and directing the pressurized nitrogen gas back into the recovery tank for purging and transferring the purified halocarbon composition from the recovery tank to a storage source.

18. The system of claim 17 wherein the halocarbon recovery and purification system includes a vent stream leading from the recovery tank and including an accumulator and a carbon adsorber and wherein the separated nitrogen gas is pressurized while held in the accumulator and carbon adsorber.

19. The system of claim 18 including a pressurized purge chamber, adapted to hold a non-reactive gas, connected to the vent stream and operative to purge purified halocarbon composition from the recovery tank.

20. The system of claim 17 wherein the means for pressurizing the separated nitrogen gas includes a vacuum recovery unit that forms a part of the system.

21. A method of purifying and removing nitrogen gas from a halocarbon, comprising the steps of:

a) directing a halocarbon composition from a source to a recovery tank;

b) separating nitrogen gas associated with the halocarbon composition within the recovery tank by cooling the recovery tank and the halocarbon composition therein to a temperature sufficient to give rise to separation;

c) removing the separated nitrogen gas from the recovery tank;

d) pressurizing the separated nitrogen gas while outside the recovery tank; and e) directing the pressurized nitrogen gas back into the recovery tank and purging the purified halocarbon composition from the recovery tank.

22. The method of claim 21 including holding the separated nitrogen gas within a carbon adsorber and pressurizing the separated nitrogen gas within the carbon adsorber causing organic halocarbon vapor to be absorbed by the carbon adsorber, and removing the absorbed halocarbon vapor by depressurizing the carbon adsorber.

23. The method of claim 22 including the step of holding the separated nitrogen gas in an accumulator and pressurizing the separated nitrogen gas within the accumulator.

24. The method of claim 23 wherein the step of pressurizing the separated nitrogen gas includes inducing the separated nitrogen gas from the recovery tank and directing the same to and through a vapor recovery unit and from the vapor recovery unit into the accumulator and carbon adsorber.

25. The method of claim 24 including purging the recovery tank by directing a non-reactive gas from a pressurized purge chamber to and through the carbon adsorber and the accumulator and from the accumulator into the recovery tank, causing the purified halocarbon composition to be transferred to a storage container.

26. A method of purifying and removing nitrogen gas from a halocarbon, comprising the steps of:

a) directing a halocarbon composition from a source to a recovery tank;

b) separating nitrogen gas associated with the halocarbon composition within the recovery tank by cooling the recovery tank and the halocarbon composition therein to a temperature sufficient to give rise to separation;

c) venting the separated nitrogen gas from the recovery tank; and d) filtering the separated nitrogen gas by directing the same through a carbon adsorber and absorbing organic halocarbon vapor from the separated nitrogen gas.

27. A method of purifying and removing nitrogen gas from a halocarbon, comprising the steps of:

a) directing a halocarbon composition from a source to a recovery tank;

b) separating nitrogen gas associated with the halocarbon composition within the recovery tank by cooling the recovery tank and the halocarbon composition therein to a temperature sufficient to give rise to separation;

c) venting the separated nitrogen gas from the recovery tank; and d) transferring the separated and purified halocarbon composition from the recovery tank to a storage tank by pressurizing the recovery tank with a non-reactive gas.

28. A method of purifying and removing nitrogen gas from a halocarbon, comprising the steps of:

a) directing a halocarbon composition from a source to a recovery tank;

b) pressurizing and cooling the halocarbon composition by directing the same through an expansion valve before the halocarbon composition has settled in the recovery tank;

c) separating nitrogen gas associated with halocarbon composition within the recovery tank by cooling the recovery tank and the halocarbon composition therein to a temperature sufficient to give rise to separation; and d) venting the separated nitrogen gas from the recovery tank.

29. A method of purifying and removing nitrogen gas from a halocarbon, comprising the steps of:

a) directing a halocarbon composition from a source to a recovery tank;

b) sensing the pressure of the halocarbon composition passing from the source to the recovery tank and once that pressure has dropped to a selected pressure level inducing halocarbon vapor from the source to and through a vapor recovery unit and therefrom to the recovery tank;

c) separating nitrogen gas associated with the halocarbon composition within the recovery tank by cooling the recovery tank and the halocarbon composition therein to a temperature sufficient to give rise to the separation; and d) venting the separation gas from the recovery tank.

30. A method of recovering and purifying a halocarbon composition that includes nitrogen and at least two different and distinct halocarbon compositions each having a different boiling point, comprising the steps of:

a) directing the halocarbon composition from a source to a recovery tank;

b) separating nitrogen gas associated with the halocarbon composition within the recovery tank by cooling the recovery tank and the halocarbon composition therein to a temperature sufficient to give rise to separation;

c) venting the separated nitrogen gas from the tank;

d) heating the recovery tank and the halocarbon composition therein to a temperature where the halocarbon composition having the lower boiling point actually boils and directing the boiling halocarbon composition from the recovery tank and collecting the lower boiling point halocarbon composition in a container; and e) purging the higher boiling point halocarbon composition from the recovery tank and collecting the same in a storage tank.

* * * * *